United States Patent [19]

Shupe

[11] 4,337,894

[45] Jul. 6, 1982

[54] WALL PROTECTIVE HEATING SYSTEM

[76] Inventor: James T. Shupe, Rt. 2, E. Brow Rd., Trenton, Ga. 30752

[21] Appl. No.: 124,383

[22] Filed: Feb. 25, 1980

[51] Int. Cl.[3] ..... F24C 5/04

[52] U.S. Cl. ..... 237/46; 237/52; 126/21 A; 98/33 A

[58] Field of Search ..... 237/51, 46, 52; 126/21 R, 21 A; 165/DIG. 2; 98/33 R, 33 A

[56] References Cited

U.S. PATENT DOCUMENTS 4,168,797 9/1979 Luke ..... 236/11

4,206,804 6/1980 Scholtes et al. ..... 165/40

*Primary Examiner*—Albert J. Makay

*Assistant Examiner*—Henry Bennett

*Attorney, Agent, or Firm*—Beveridge, DeGrandi & Kline

[57] ABSTRACT

A space heating stove is located near a wall-supported shield which has an internal airflow passage. Heat radiated by the stove to the shield heats air in the airflow passage, and a fan moves this heated air from the channel into a duct system which releases the heated air into the building.

12 Claims, 9 Drawing Figures

WALL PROTECTIVE HEATING SYSTEM

BACKGROUND OF THE INVENTION

In recent years, there has been a great resurgence in the use of wood burning stoves. Such devices do not always lend themselves to modern floorplans because the substantial amount of radiated heat precludes placement of such stoves too close to the walls of a room. To some extent, this problem can be dealt with by placing a thermal insulating or refractory material on the adjacent wall, suitable materials of this type being stone, brick or asbestos sheeting. A more recent proposal, disclosed in U.S. Pat. No. 4,008,705 issued Feb. 22, 1977 to James H. Robertson, involves the use of large vertical panels with internal airflow passages which permit the convective movement of air from a lower air inlet grill to an upper air outlet grill.

A need has also been recognized for introducing heat from a wood burning stove into the air distribution system of a modern furnace. Presently, the only convenient way to achieve this is to purchase an add-on wood furnace which sits beside the conventional furnace and is connected to the central heating system. While this system is effective, it requires the purchase of a specialized piece of equipment which, by its very nature, must be placed at an inconvenient location.

SUMMARY OF THE INVENTION

The present invention provides a system which serves the twofold functions of protecting the wall near a space heating stove, and providing heated air to areas of the building which do not receive significant heat from the stove. The system may also move any warmer air which collects near the ceiling to lower areas in the room or building.

According to the invention, a system for protecting a wall of a building from heat emitted by a free standing stove near the wall includes a channel with a thermally conductive panel and an internal air flow passage, and means for mounting the channel on a wall adjacent to the stove where one surface of the thermally conductive panel faces the stove to receive heat therefrom and the opposite surface of the panel faces the airflow passage to heat air in the channel. A fan moves air from the channel and through a ductwork system to an outlet which is in the building and spaced from the stove and channel.

The invention also involves a complete heating system for a building which includes a space heating stove for burning solid combustible materials, a furnace, an air return duct leading to the furnace and at least one air supply duct which leads from the furnace into a room of the building. This system comprises a channel with an internal airflow passage located adjacent to the stove, this channel including a thermally conductive panel which is in adjacent facing relationship to the stove to receive heat therefrom and to heat air in the airflow passage. A connector duct connects the airflow passage to the air return duct of the furnace, and the furnace fan draws hot air from the channel and through the connector duct into the air return duct. The outlet side of the fan is connected to the furnace air supply ducts to deliver air heated in the airflow passage by the stove into at least one room of the building.

Preferably, the duct system includes a connector duct which leads from the airflow passage and connects to the return air duct of a conventional furnace. The furnace blower serves as the fan, and the heated air is distributed by supply ducts which lead from the hot air plenum of the furnace into the rooms of the building. For control purposes, it is preferred to provide a temperature sensor on the panel near the stove, and means for activating the fan in response to signals from the temperature sensor. The channel includes a plurality of interconnected sections of U-shaped cross section, two of which are overlapping in vertically slidable relation to permit height adjustment of the channel during installation before it is affixed to the wall. Also, it is preferred to provide the channel with an air inlet which is open to an upper part of the room near the ceiling, and the duct for receiving the heated air will have its inlet end connected to a lower portion of the airflow passage within the channel.

The invention may take a wide variety of forms, exemplary ones of which are shown in the drawings and described in the following text.

BRIEF DESCRIPTION OF THE DRAWINGS

FIG. 9 depicts the heat suppying hot air to a heat pump.

DESCRIPTION OF THE PREFERRED EMBODIMENTS

Figure 1:
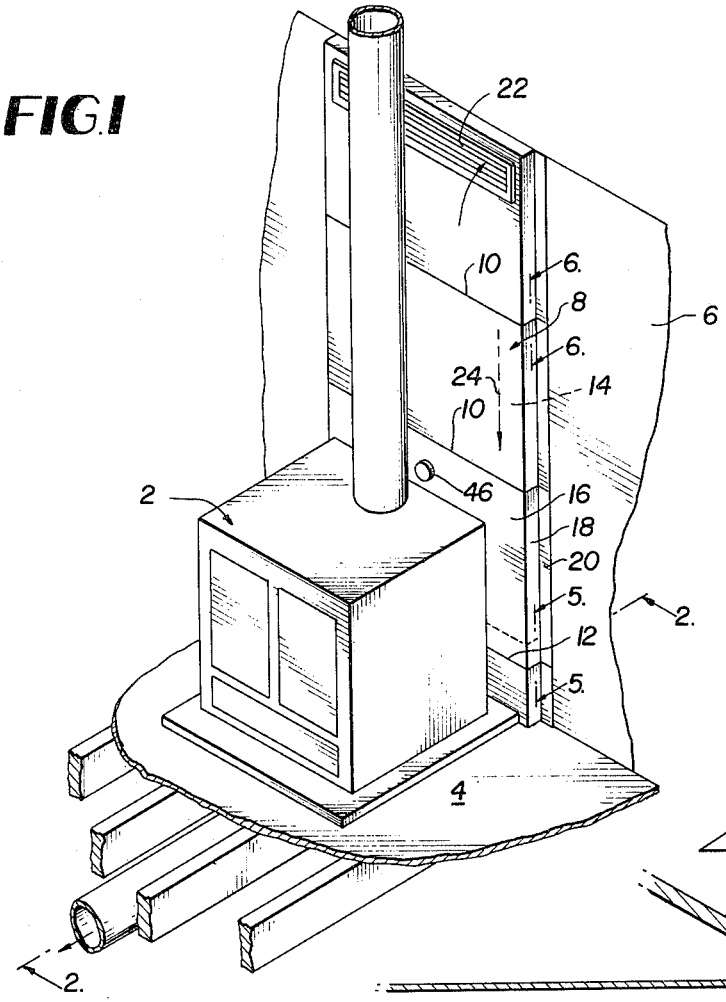
FIG. 1 is a perspective view showing a heat-receiving shield mounted on a wall near a space heating stove.

FIG. 1 shows a portion of a room in which a space heating stove 2 for burning solid combustible material such as wood is supported on a floor 4, relatively close to the wall 6. A shield is mounted on the wall 6 to protect the wall from heat irradiated by the stove 2. This shield is in the form of a channel 8 which is formed of four vertically disposed sections which are connected at joints 10 and 12 to provide an internal airflow passage designated 14 in FIG. 2.

Figure 7:
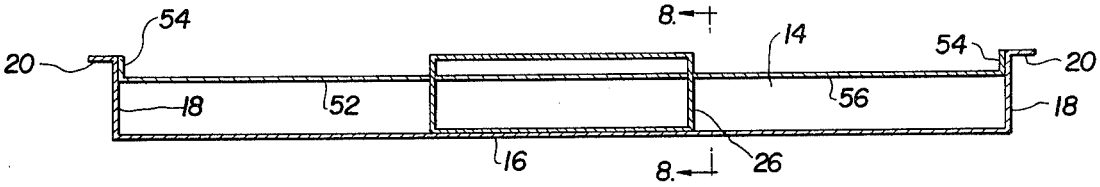

The channel is formed of a thermally conductive material such as sheet metal and, as shown in FIG. 7, it includes a front panel 16, two sidewalls 18, and two outturned flanges 20 which receive screws or nails to affix the channel on the wall. The front panel 16 is disposed with its outer surface facing the stove 2 to receive radiant heat from the stove. The outer surface is preferably treated by blackening or other means to enhance its radiation absorption. The inner surface of panel 16 faces the airflow passage 14 in order to heat the air in the channel 8.

Figure 2:
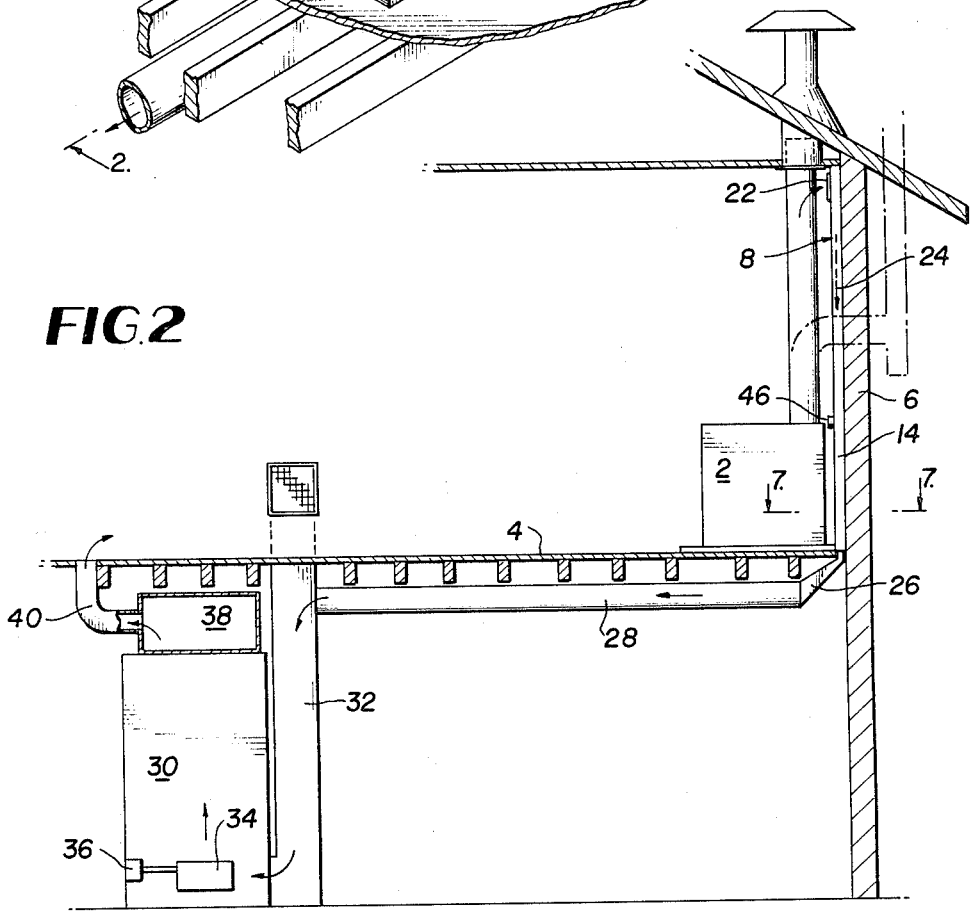
FIG. 2 is a diagrammatic vertical section which shows the overall system including a conventional furnace.
Figure 3:
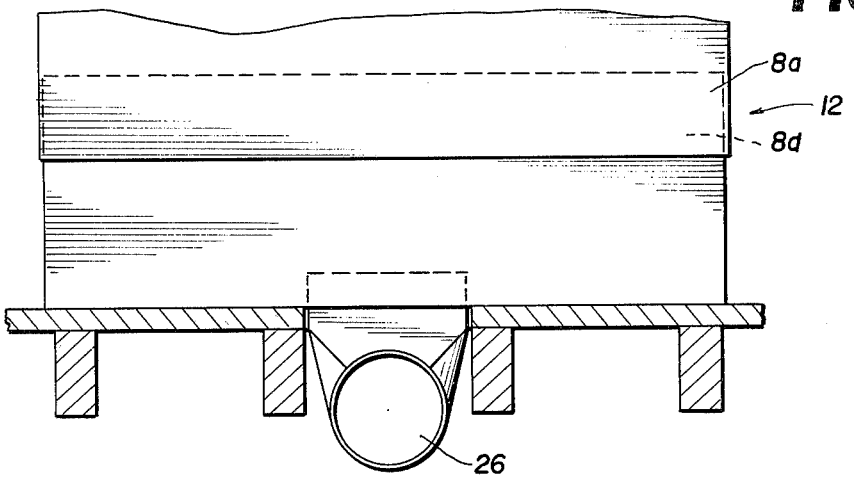
FIG. 3 is a vertical sectional view of a heat-receiving shield arranged for downward air circulation.

The upper section of channel 8 is provided with an air inlet grill 22 which is open to the upper part of the room near the ceiling. As shown in FIGS. 2, 3, 7 and 8, the internal airflow passage 14 in channel 8 has an air outlet at its lower end so that air moves downwardly within the channel as indicated by the arrow 24 in FIG. 1. This air outlet includes a boot 26 which extends upwardly from the floor and into the airflow passage. The boot includes a transition section and a circular outlet end which is connected to a connector duct 28 which is shown in FIGS. 1 and 2.

FIG. 2 shows a conventional household furnace system which includes a furnace 30, an air return duct 32 leading from a room to the furnace, and a fan or blower 34 actuated by conventional controls 36 for drawing hot air from the return duct 32 and moving it upwardly through a heating section into the hot air plenum 38. A plurality of air supply ducts, one of which is shown at 40, lead from the plenum 38 to the rooms of the building.

As shown in FIG. 2, the connector duct 28 from the wall-shielding channel 8 is connected to the furnace air return duct 32. Therefore, when the furnace fan 34 is operating, it will draw air through grill 22 into the airflow passage in channel 8. Air in the channel 8 heated by the stove 2 will be carried through boot 26, connector duct 28 and air return duct 32 to the fan 34. Thereafter, the heated air will move upwardly through the furnace to the plenum 38 and into the air supply duct 40 which introduces it into the room at a point spaced from the channel 8 and stove 2.

Figure 4:
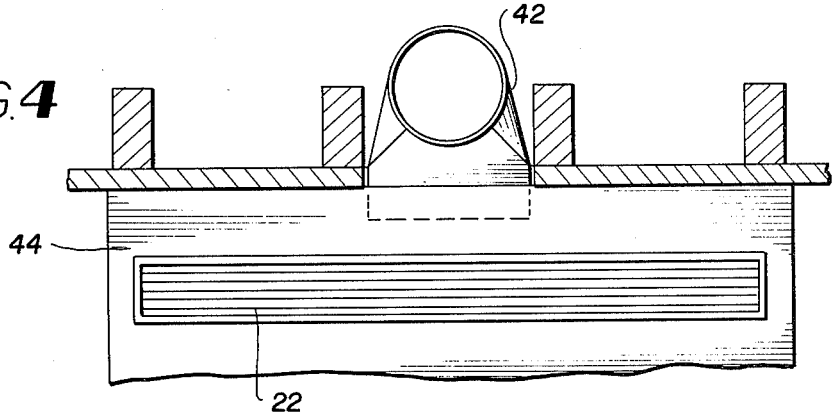
FIG. 4 is a sectional partial view of a heat shield which is installed for upward air circulation.
Figure 5:
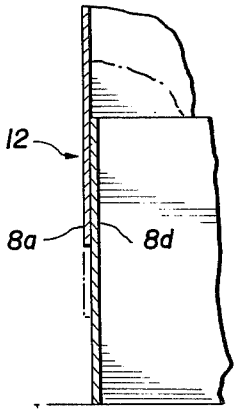
FIG. 5 shows the slidable overlapping joint between the two lowermost channel-forming sections.

In homes with attic hot air distribution systems, it is preferred to position the boot between the ceiling joists as shown in FIG. 4. In this instance, the boot is designated 42. The sidewalls of channel 44 are provided with supplemental air openings at or below the elevation of the stove so that air heated by the stove will be drawn upwardly into the boot 42 and carried by an in-line blower or furnace blower to another room or area of the building.

Although the fan may be activated by a manual switch, it is preferred to provide the thermostatic controls which activate the air circulating fan or blower when the temperature of the panel near the stove is above an appropriate selected temperature. FIGS. 1 and 2 show a temperature sensor 46 mounted on the front panel 16 of the channel 8. When the temperature sensed by this device 46 reaches a predetermined level, it will send a signal to a relay in the fan controls 36 which will turn the fan on. When the fan is running, the air in channel 8 which has been heated by the stove 2 will be drawn through the boot 26, connector duct 28 and air return duct 32 to the suction side of the fan 34. From the discharge side of the fan, the heated air is fed to the furnace plenum 38 and the air supply duct 40 into the room. When the temperature sensed by the device 46 falls below the predetermined level, the fan 34 will be deactivated and air circulation will be terminated. Of course, the existing furnace control will remain unaltered so that on some occasions the air heating system of the furnace will operate simultaneously with this invention. Even when the stove 2 is not operating, the furnace fan 34 will operate as usual in connection with the operating cycle of the furnace 30.

Preferably, the shield 8 is supplied to the installer in separate sections which have their horizontal edges preformed to form a joint with an adjacent section. FIG. 1 shows a shield channel formed of four sections which are connected together by two snap-lock joints 10 and one vertically slidable joint 12.

Figure 6:
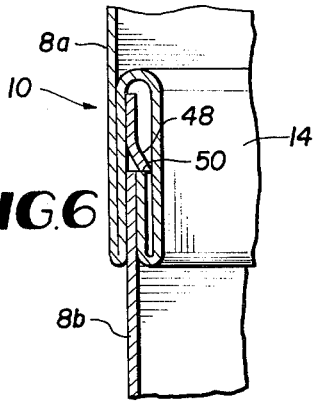
FIG. 6 depicts a snap lock sheet metal joint made between adjacent pairs of the upper channel-forming sections.

In a suitable snap-lock joint 10 shown in FIG. 6, the lower edge of the upper section **8*a* is bent to form a downwardly-open U-shaped slot for receiving the upper edge of the lower section 8*b*. The lower section is provided with integral resilient tangs 48 which slide upwardly into the slot on the upper section and then snap to the position shown in FIG. 6 where the tang 48 is engaged against an upwardly-facing abutment edge 50** in the upper slot.

The slidable joint 12 shown best in FIG. 7 provides the channel 8 with a height adjustability. The mating overlapping edges **8*c* and 8*d* of the adjacent sections are slid relative to each other until the entire shield occupies the full height of the room. When they are set at an appropriate height, the sections are affixed to the wall by driving nails or screws through the flanges 20**.

Figure 8:
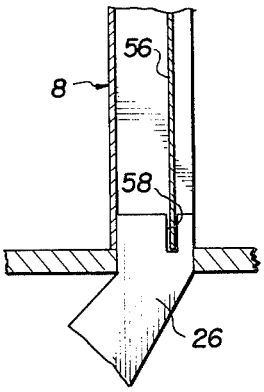
FIGS. 7 and 8, respectively, are horizontal and vertical sectional views taken through lower portions of the heat shield channel of FIGS. 1, 2 and 3.

To afford further protection to the wall of the building, it is desirable to place a layer of insulation material or a shield in the rear of channel 8. Preferably, the sheet metal shield 52 shown in FIGS. 7 and 8 is used. It includes side flanges 54 and a main panel 56 which lies parallel to and is spaced about one-half inch from the wall of the room. The side flanges 54 assist in maintaining this spacing, as does the provision of slots 58 in the inlet end of the boot 26 as shown in FIG. 8. The upper edge of the shield is higher than the upper surface of the stove 2.

From the foregoing, it will be appreciated that this invention provides an inexpensive, uncomplicated system for shielding walls from heat emitted by stoves, and for diverting such heat to other areas of the building. Persons familiar with the field of the invention will realize that it may take many forms other than the preferred embodiment disclosed above. For example, the channel of the shield may have many different shapes, the ductwork may be flexible and an in line blower may be used in buildings which are not equipped with central heating furnaces. Therefore, it is emphasized that the invention is not limited only to this embodiment, but is embracing of modifications thereof and improvements thereto which fall within the spirit of the following claims.

ADDENDUM

Since a relatively high return air temperature (above 80° F.) is undesirable for heat pump installations, the heated air from the wall shield may be introduced into central warm air supply (FIG. 9, at 1) by means of an in-line blower (FIG. 9, at 2). In this configuration, the heat switch (FIG. 9, at 3) would activate the in-line blower instead of the central system blower.

I claim:

1. A system for protecting a wall of a building from heat emitted by a free standing stove near the wall for burning solid combustible materials, comprising, a channel having an internal airflow passage and an air inlet opening at the upper end of the airflow passage to receive air from an upper part of the room, said channel including a thermally conductive panel which has a width for laterally spanning the space between the stove and the wall, said channel being formed of a plurality of interconnected sections of U-shaped cross section, means for mounting the channel on a wall adjacent to the stove where one surface of the panel faces said stove to receive heat therefrom and the opposite surface of the panel faces the airflow passage to heat air in the channel, duct means having an inlet end connected to the airflow passage in the channel and an outlet end which is in the building and spaced from the stove and channel, a fan for drawing air into the air inlet from an upper part of the room and moving air from the channel and through the duct to the outlet where the air is released into the building.

2. A system according to claim 1 in combination with a central heating system which includes a furnace with air heating means, a return air duct leading to the furnace, and at least one hot air supply duct leading from the furnace to a room of the building; said duct means including (i) a first duct section leading from the channel to said return air duct, (ii) the return air duct and (iii) said air supply ducts, said furnace having a blower which serves as said fan.

3. A system according to claim 1 including a temperature sensor on the panel near the stove, and means for activating the fan in response to signals from the temperature sensor.

4. A system according to claim 1 wherein the duct means has its inlet end connected to a lower portion of the airflow passage.

5. A system according to claim 1 wherein the channel includes a pair of overlapping sections which are vertically slidable relative to each other during installation before they are affixed in position on the wall.

6. A system according to claim 1 including a duct which connects the fan discharge to the warm air supply side of a central heating system.

7. A heating system for a building which has a space heating stove for burning solid combustible materials, a furnace, an air return duct leading to the furnace and at least one air supply duct which leads from the furnace into a room of the building, comprising, a channel with an internal airflow passage located adjacent to the stove and on a wall of the room, said channel having an air inlet opening at its upper end to receive air from an upper part of the room, said channel including a thermally conductive panel which is in adjacent facing relationship to the stove to receive heat therefrom and to heat air in the airflow passage, said panel having a width which laterally spans the space between the stove and the wall, a connector duct connecting said airflow passage to the furnace air return duct, a fan in said furnace for drawing hot air from the channel and through the connector duct into said air return duct, said fan having its outlet side connected to said air supply duct to deliver air heated in the airflow passage into at least one room of the building.

8. A heating system according to claim 7 including thermostatic control means for activating the fan when the temperature of the panel near the stove is above a given temperature.

9. A heating system according to claim 7 wherein said connector duct is connected to a lower portion of the airflow passage.

10. A heating system according to claim 7 wherein the channel includes a pair of overlapping sections which are vertically slidable relative to each other to facilitate installation.

11. A heating system according to claim 7 wherein the channel includes a plurality of interconnected sections of U-shaped cross section.

12. A system according to claim 1 in combination with a central heating system which includes an air heating means and at least one warm air supply duct leading from the air heating means to a room of the building, said duct means including the hot air supply duct and a duct section which leads from the channel to the warm air supply duct, said fan being located in said duct section.

* * * * *